United States Patent [19]

Jenks

[11] Patent Number: 4,656,994

[45] Date of Patent: Apr. 14, 1987

[54] BOWSTRING RELEASE DEVICE AND ADJUSTABLE BOW SIGHT

[76] Inventor: Charles C. Jenks, Rte. 1, Box 42, Norwood, N.Y. 13668

[21] Appl. No.: 687,944

[22] Filed: Dec. 31, 1984

[51] Int. Cl.[4] ..... F41C 19/00; F41B 5/00; F16B 39/12; F41G 1/00

[52] U.S. Cl. ..... 124/23 R; 124/35 A; 124/87; 124/90; 124/91; 411/222; 411/400; 33/265; 273/416

[58] Field of Search ..... 124/35 A, 87, 90, 91, 124/23 R, 24 R; 33/265; 411/931, 222, 400

[56] References Cited

U.S. PATENT DOCUMENTS

| | | | |
|---|---|---|---|
| 1,044,412 | 11/1912 | Newton | 411/222 |
| 1,542,159 | 6/1925 | Maxwell | 124/35 A |
| 2,819,707 | 1/1958 | Kayfes et al. | 124/35 A |
| 3,672,346 | 6/1972 | Plumb | 124/87 |
| 3,703,771 | 11/1972 | Saunders | 33/265 |
| 4,201,182 | 5/1980 | Butler | 124/24 R |

*Primary Examiner*—Richard C. Pinkham
*Assistant Examiner*—Benjamin Layno
*Attorney, Agent, or Firm*—Bruns and Wall

[57] ABSTRACT

A bow system that includes a release mechanism that engages simultaneously a spool on the bowstring and a nock on the arrow that are arranged to automatically hold the arrow centered during the arrow drawing and release procedures. A rear sight is further mounted upon the bowstring that has an eyelet threaded into a swage lock to the string. The eyelet can be turned to any alignment desired and locked in place using a locking nut.

7 Claims, 12 Drawing Figures

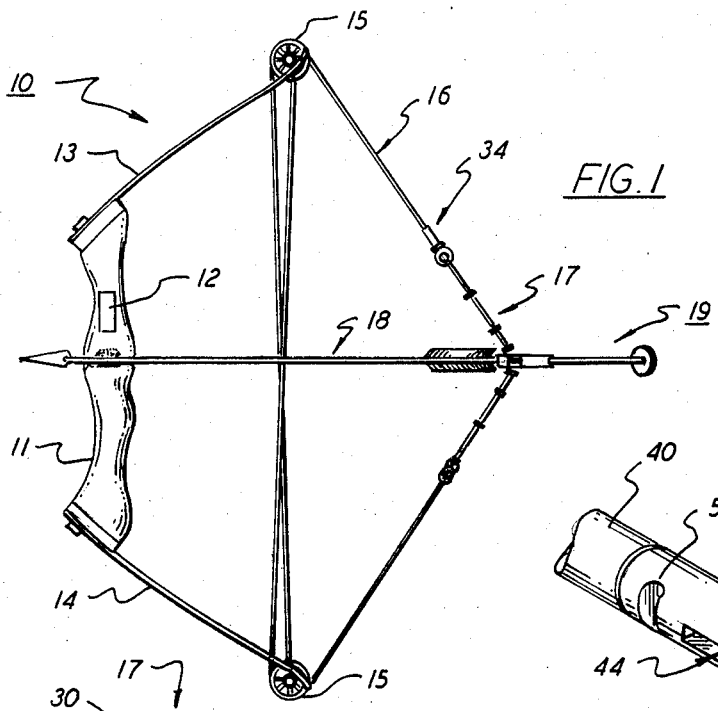
FIG. 1
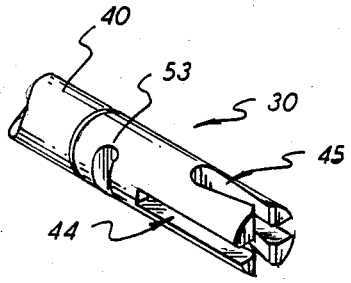
FIG. 4
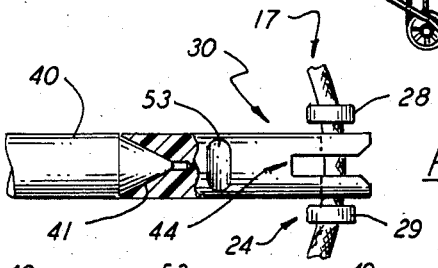
FIG. 5
FIG. 6
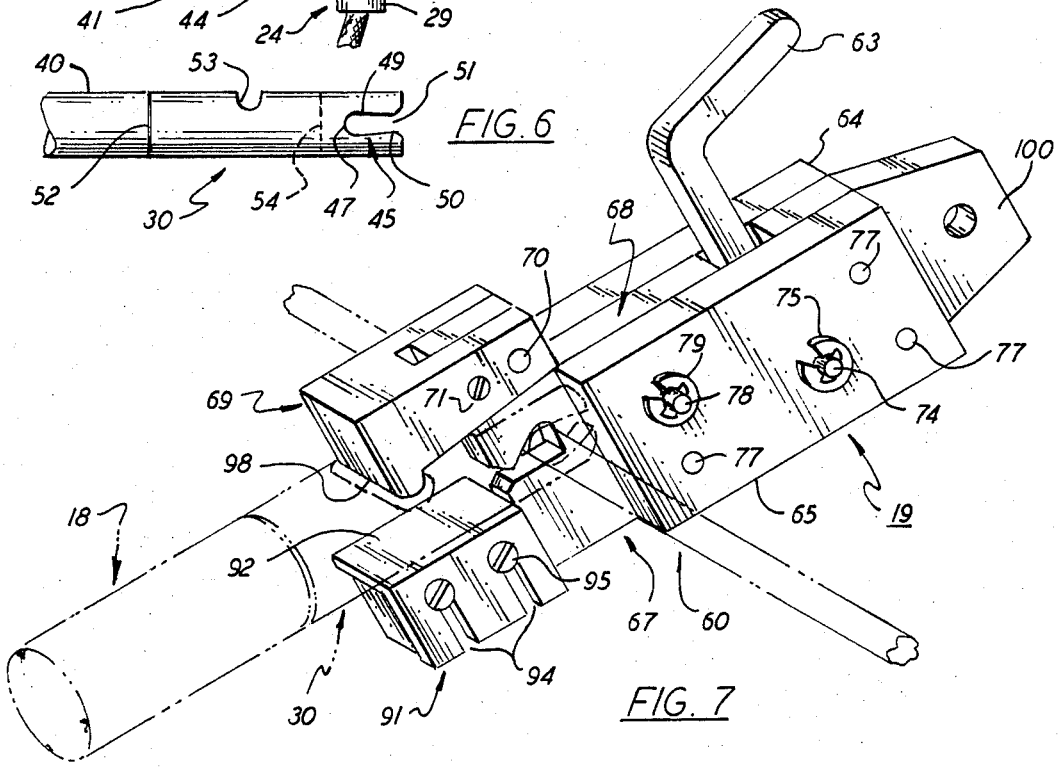
FIG. 7

BOWSTRING RELEASE DEVICE AND ADJUSTABLE BOW SIGHT

BACKGROUND OF THE INVENTION

This invention relates to an improved system for aiming and firing a bow equipped with a peep sight. More specifically this invention relates to a center shot archery system for improving the accuracy of both new and existing bows.

Today's archers generally fire compound bows and combinations of compound and recurved bows using mechanical releases and different types of sighting devices. This advanced technology adds considerably to the accuracy that can be achieved by hunters and target shooters alike. Even with these advances in technology, most archers are nevertheless releasing their arrows in a manner that places an off centering force on the arrow. Typically, when drawing an arrow, the archer's fingers or a mechanical release are placed on one side of the nock. As a consequence, the bowstring is not drawn even with the back string receiving surface of the nock and an uneven pressure is applied to the arrow at the time of release which adversely effects the flight of the arrow. Under these conditions, the nock also has a tendency to pop off the string. When the arrow is fired it tends to alter the direction from the sighted line and the arrow is launched in an "off center" attitude which, if not compensated for, causes the arrow to miss the target.

A second problem usually encountered by most archers using a peep sight involves the alignment of the sight. The peep sight is a rear sight that is usually mounted upon the bowstring. The peep cooperates with a front sight affixed to the bow handle. The peep sight is provided with a peripheral groove for receiving string strand therein. The sight is mounted by separating the strands at a predetermined position with an equal number of strands passing to either side of the sight. After the peep sight is mounted, it is locked in place using nock sets. Keeping the sight aligned so that the archer can view the front sight, however, has long been a problem in the art. The string can with usage and resetting become twisted thus causing misalignment of the peep. Realigning the sight is generally a tedious and sometimes fruitless task. Seldom is it possible to get the peep perfectly aligned because the string will turn or twist each time the bow is broken down as for example when it is stored or being transported. Invariably when the bow is again set up, the peep will be out of alignment and a good deal of time is wasted getting it readjusted.

Although a large number of systems have been devised for use with bows, none of these systems solves the noted problems associated with off center firing and peep sight misalignment. Some of these prior art systems are disclosed in the following United States patents:

| | | |
|---|---|---|
| 2,936,749 | 4,134,369 | 4,316,443 |
| 3,847,133 | 4,151,825 | 4,392,475 |
| 4,004,564 | 4,173,210 | 4,083,348 |
| 4,105,011 | 4,249,507 | |

SUMMARY OF THE INVENTION

It is therefore a primary object of the present invention to improve bows used in archery.

It is a further object of the present invention to provide a bow system that is capable of launching an arrow along a predetermined path of travel that is described by the axis of the arrow.

A still further object of the present invention is to eliminate off centering forces acting on an arrow during drawing and firing of the arrow.

Another object of the present invention is to provide a center shot archery system having a peep sight that can be quickly and accurately aligned.

These and other objects of the present invention are attained by means of a center shot archery system having a bow drawing and release unit that is arranged to engage both the string of the bow and the nock of the arrow drawing and aiming to hold the arrow centered in the unit. A trigger mechanism releases the bowstring and the nock simultaneously at the moment of firing. The bowstring contains a nocking spool that mates with a complementary slot in the nock to symetrically seat the string within the nock and further provides a bearing surface against which the release mechanism acts. A rear sight is mounted upon the bowstring that includes a peep eyelet having a shank that is threaded into a swage which is, in turn, secured to the bow cable. A finger activated lock nut is threaded onto the shank which is operable to lock the peep in any desired angular position in reference to the string thus enabling the peep to be quickly set in the field.

BRIEF DESCRIPTION OF THE DRAWINGS

For a better understanding of these and other objects of the present invention reference is had to the following detailed description of the invention which is to be read in conjunction with the accompanying drawings wherein:

FIG. 1 is a side view of a compound bow embodying the teachings of the present invention showing the bow in a fully drawn position;

FIG. 4 is a perspective view showing an arrow mounted nock used in association with the present invention;

FIGS. 5 and 6 are top and side elevations of the nock shown in FIG. 4;

FIG. 7 is an enlarged view of a release mechanism used to engage the nock for the purpose of drawing and firing;

DESCRIPTION OF THE INVENTION

Figure 2:
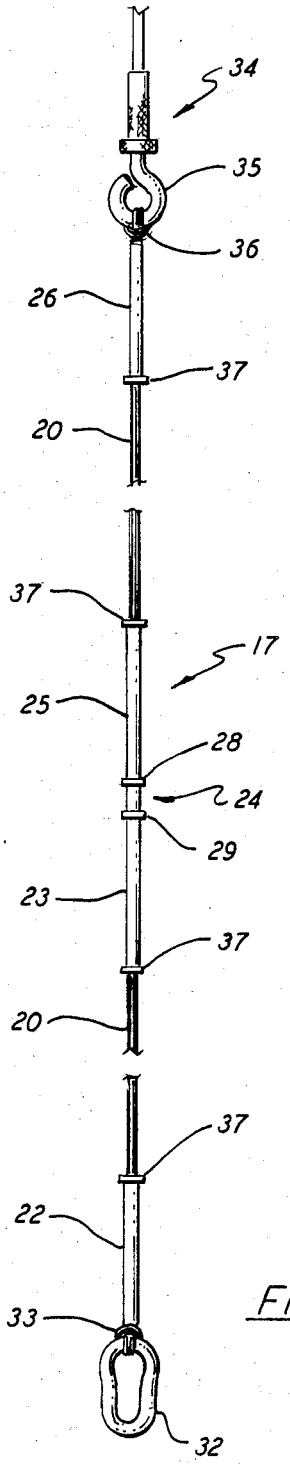
FIG. 2 is an enlarged view of the bowstring used in the practice of the subject invention.

Turning initially to FIG. 1, there is shown a compound bow, genereally referenced 10, that includes the center shot system of the present invention. The bow includes a handle 11 to which is attached an upper limb 13 and a lower limb 14. A pair of pulleys 15—15 are mounted upon the extreme ends of the limbs over which are trained a cable 16 of conventional design. A bowstring, generally depicted at 17, is secured to the cable and is arranged to engage a nock mounted upon the end of arrow 18. A release mechanism 19 for drawing and firing the bow is also shown engaging the bowstring at the nock end of the arrow. As will be explained in greater detail below, the release mechanism is uniquely mated to the bow and forms part of a system that considerably expands the utility and accuracy of the instrument without having to alter its basic construction. A peep sight unit 34 is mounted upon the bowstring which coacts with a front sight, generally depicted at 12, of any suitable design for aiming the bow at a target. As will be explained below, the peep sight can be accurately aligned by the archer in a matter of seconds without having to disconnect the bowstring from the cable, a feat heretofore generally unattainable in the art. Although a compound bow is illustrated in FIG. 1, it should become evident from the disclosure below that the present invention can be used in association with almost any type of hand drawn bow known and used in the art.

Referring now to FIG. 2, there is shown the construction of the bowstring 17 that is utilized in the system of the present invention. It should be noted that the instant bowstring is not constructed in the same manner as a conventional bowstring and is not interchangeable therewith. The bowstring is made from a single length of waxed dacron 20 having a tensil strength of about fifty pounds. In assembly the string is wound about two spaced apart posts (not shown) to make five complete turns. The string thus consists of ten parallel strands of dacron having an overall tensil strength of 500 pounds. The two ends of the loop are tied together using a barrel knot with the knot being located close to one of the posts. One end of the string is slipped from its winding post and a pair of close running sleeves 22 and 23 are passed in series over the string and moved to the opposite end of the string. The outermost sleeve 22 is passed over the knot close to the lower end of the string. Next a nocking spool 24 is pushed over the string followed by a second pair of sleeves 25 and 26. Care is taken at this time not to twist or otherwise disturb the parallel alignment of the strands making up the string during the threading operation.

The nocking spool 24 is a hollow tubular member that has a close running fit with the bowstring. Both ends of the spool are provided with radially extended, dependant flanges 28 and 29. As will be explained in greater detail below, the spool is dimensioned so that it can be slidably received within a nock 30 fitted to the end of an arrow bolt or shank 41 (FIG. 5). The spool thus provides a rigid bearing surface against which the nock acts during drawing and firing so that the string bears squarely on the nock during all phases of the shooting operation.

A double oval link 32 is attached to the lower end of the bowstring by looping the string back over itself with the link inside the loop as depicted at 33. After removing the opposite end of the string from the other post, the adjustable peep sight assembly 34 is attached to the opposite or upper end of the string as viewed in FIG. 2 by similarly looping the string back over itself with the eyelet 35 of the assembly inside the loop 36. The string is hung in a vertical position for at least one hour with a 250 pound weight suspended therefrom to develop a set in the looped strands. Upon removal of the weight, the outermost sleeves 22 and 26 are pushed as close as practical against the string loops at both ends of the string. Each sleeve is then secured in place using nock set points 37—37 that are crimped in holding contact against the string.

Figure 3:
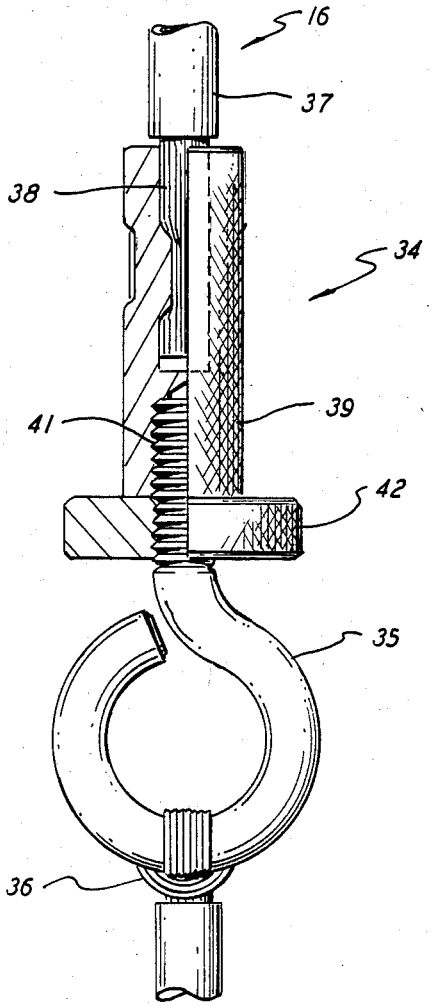
FIG. 3 is a further enlarged view in partial section showing a peep sight assembly used in association with the noted bowstring.

The bowstring is assembled to the bow cable using a bow flexing fixture that is capable of holding the bow securely in a fully flexed condition. With the bow flexed, the upper teardrop anchor conventional provided with the bow cable is removed and about one half inch of the cable cover 37 is cut away to expose the underlying wire strands 38 (FIG. 3). The exposed end of the cable is slipped into swage member 39 of the peep sight assembly and is secured therein by crimping the swage inwardly at a plurality of points to lockingly engage the cable. The double oval link 32 is now slipped into engagement upon the lower teardrop anchor on the opposite end of the cable to complete the string connection. The bow is now released from the fixture and the nocking spool is aligned using a conventional bow square. The two inner sleeves 23 and 25 are placed in abutting contact against the spool flanges and the sleeves locked in this holding position by means of the associated nock set points 37—37.

Turning now to FIG. 3, the peep sight assembly 34 is shown in greater detail. The assembly mechanism is uniquely designed to allow the rear sight of the bow to be quickly and accurately aligned with the front sight without having to adjust or otherwise manipulate the bowstring. The assembly includes previously noted eyelet 35 having a threaded shank 41 that is screwed into the swage 39 so that the eyelet can be axially aligned with reference to the front sight by simply turning the shank in the swage. A circular locknut 42 is also threaded onto the shank of the eyelet which is adapted to lock against the top end face of the swage and thus securely lock the eyelet at any preselected setting. The outer surfaces of both the locknut and the swage are knurled to facilitate loosening and tightening of the locknut by hand.

As can be seen, the peep sight is a simple mechanism that acts as a swivel at the normal upper teardrop anchor point. To align the peep eyelet upon the front sight, the archer simply has to loosen the locknut and turn the eyelet to a desired position. Once aligned, the locknut is finger tightened to securely lock the eyelet in place. The entire aligning procedure normally takes but a few seconds to complete.

A nock, generally referenced 30, for use in the present system is shown in detail in FIGS. 4–6. The nock is a cylindrical member having an outside diameter that complements the geometry of the arrow shaft 40 and will not disturb its flight characteristics. The front of the nock is furnished with a conical shaped opening 41 that is adapted to receive the similarly shaped back end of the arrow shaft therein. The nock is joined to shaft using any suitable means as known and used in the art.

The distal or back face of the nock contains a pair of orthogonically offset slots. Each slot is passed longitudinally through the back face along a major diameter of the nock. The slots include a first deeper cut herein referred to as the release slot 44 and a second slot 45 of lesser length which is herein referred to as the nocking slot. The release slot is generally rectangular in shape and is adapted to accept therein a pair of coacting jaws contained in the previously noted release mechanism 19 (FIG. 1). The nocking slot has a circular bottom wall 47 that is adapted to receive the nocking spool 24 of the bowstring. The side walls of the nocking spool slot 49 and 50 taper down rearwardly to form a neck 51 at the chambered entrance to the slot. The tapered slot is designed to center the spool along the axis of the arrow while at the same time furnishing positive bearing contact which reduces the tendency of the string to snap at the time of release.

A semicircular gripper groove 53 is cut laterally into the peripheral surface of the nock about midway between the front end face 52 of the nock and the bottom wall 54 of the release slot. The longitudinal axis of the semicircular groove is generally perpendicularly aligned with the axis of the release slot so that the groove will be parallel to the nocking spool 24 when the spool is seated within the nocking slot as shown in FIG. 5. Although a semicircular groove 53 is shown in the drawings, the geometry of the groove can be formed to any desirable shape to facilitate easy insertion and removal of a locking bar 98 (FIGS. 5 and 12) therein. For example, the groove can be triangular in form and positioned so as to smoothly receive and release a complementary locking bar in the manner as described below in greater detail.

The release or triggering mechanism 19 of the present system is shown in greater detail in FIGS. 7–12. The release mechanism is a dual action device adapted to engage the previously noted arrow mounted nock in a manner that permits the arrow to be drawn easily to a firing position. More importantly, once drawn, the mechanism controls the release of the arrow so that it is launched by the bowstring along a path of flight described by the axis of the arrow. This center shot launch eliminates much of the inaccuracy found in many existing systems.

The release mechanism 19 includes a release head 60, an elongated hand grip 61 and a pressure plate 62. The release head is arranged to simultaneously engage both the nocking spool on the bowstring and the arrow nock to permit the string to be drawn securely back to a fully drawn position as shown in FIG. 7. After the target is sighted, the trigger 63 of the mechanism is depressed to release the arrow nock and the bow string simultaneously. The release head contains a pair of side plates 64 and 65 between which are supported a stationary jaw 67 and a movable jaw 68. They coact to releasably engage the nocking spool. A locking member 69 is adjustably mounted upon the movable jaw 68 by means of a pin 70 and a threaded fastener 71. The threaded fastener is arranged to pass through a slotted hole 72 provided in the body of movable jaw.

Figure 10:
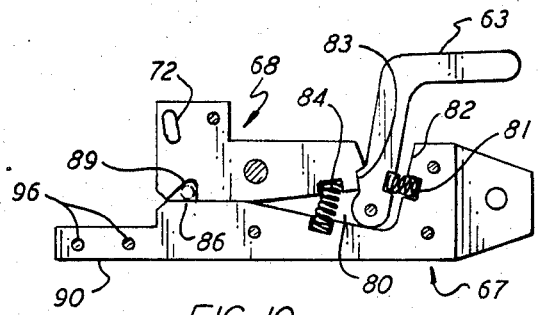
FIG. 10 is a side elevation illustrating the trigger and release jaw assembly used in the noted release mechanism.

The trigger is an L-shaped member that is pivotally supported between the side plates by means of a pivot pin 74 that is held in assembly by a clip washer 75. The stationary jaw 67 is secured between the side plates by three mounting pins 77—77 that are stacked to the plates in assembly to prevent them from being inadvertently removed. The movable jaw 68 is also pivotally supported between the plates by means of a second pivot pin 78 which is held in assembly by means of clip washers 79 (FIG. 7). The proximal or pivot end of the trigger is carried in a recess 80 formed in the back of the stationary jaw. A compression spring 81 is mounted between the trigger and wall 82 of the stationary jaw which acts to bias or urge the trigger in a counterclockwise direction about pin 75 as viewed in FIG. 10. A second tension spring 84 is also mounted in the recess region which acts between the stationary jaw 67 and the movable jaw 68 to urge the movable jaw in a clockwise direction about pin 78. The trigger contains an escapement 83 that is adapted to seat within a recessed stop 85 (FIG. 12) formed in the movable jaw in a closed condition against seating surface 86 located on the coacting stationary jaw (FIG. 10).

Figure 8:
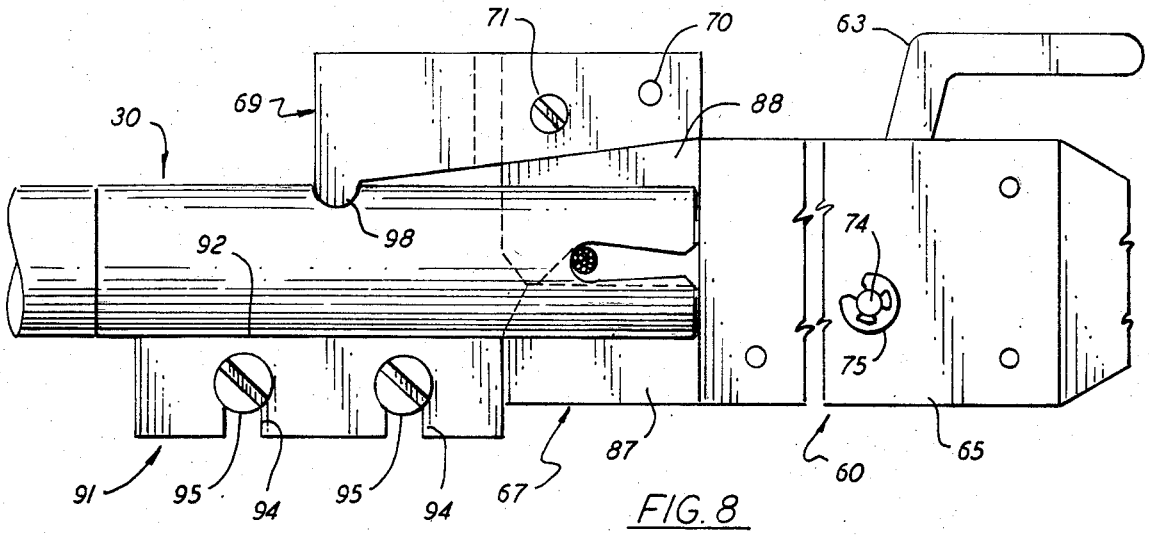
FIG. 8 is an enlarged side elevation of the release mechanism.
Figure 9:
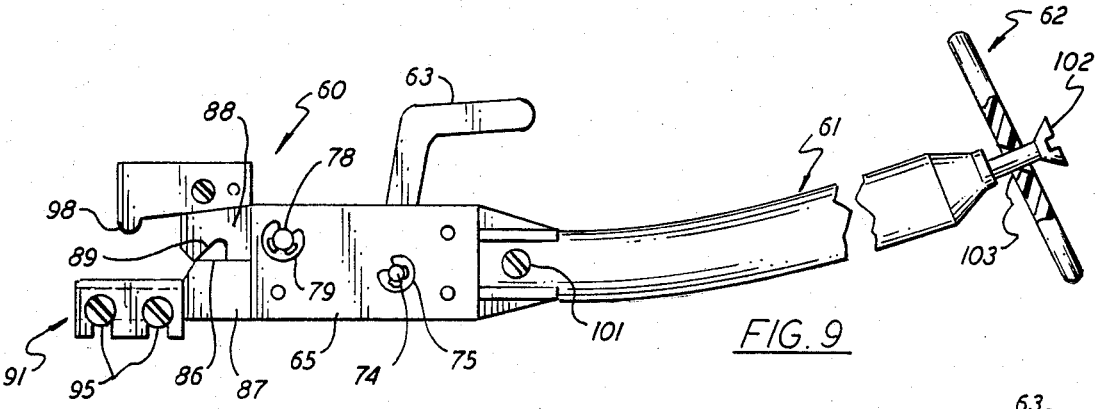
FIG. 9 is also a side elevation showing the release mechanism attached to a handle having a back pressure plate.

The forwardly extended sections 87 and 88 jaw members 67 and 68, respectively, protrude outwardly from the front end walls of the two side plates and are adapted to be slidably received within the deeper release slot of the nock. The movable jaw 67 contains a notch 89 that is contoured to close around the nocking spool of the bowstring when the spool is seated within the nocking slot. As best seen in FIG. 8, the stationary jaw member 67 also contains an extended support bracket 90 (FIG. 10) upon which is mounted an L-shaped rest 91. The rest includes a table 92 and a downwardly turned leg 93 having a pair of slotted holes 94—94 therein. A pair of adjusting screws 95—95 are passed through the slotted holes and are threaded into tapped holes 96—96 (FIG. 10) provided in the support bracket 90 so that the table can be raised and lowered in assembly. In practice, the arrow nock rest upon the table when it is engaged by the jaw members.

The locking member 69, which is adjustably mounted upon the top of the movable jaw, is arranged to engage the peripheral groove formed in the nock when the jaws are placed in a closed condition about the nocking spool. The member includes a downwardly extended semi-circular bar 98. The bar is arranged to enter the groove when the jaws are closed. Both the table and the locking member are adjusted in assembly to hold the arrow in a centered position when the nock is engaged by the jaw, that is, while the arrow is being brought to a firing position.

Figure 11:
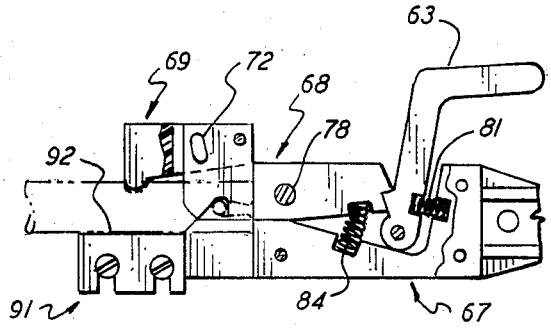
FIG. 11 is a side elevation showing the jaws in a closed condition with a nock secured therebetween.
Figure 12:
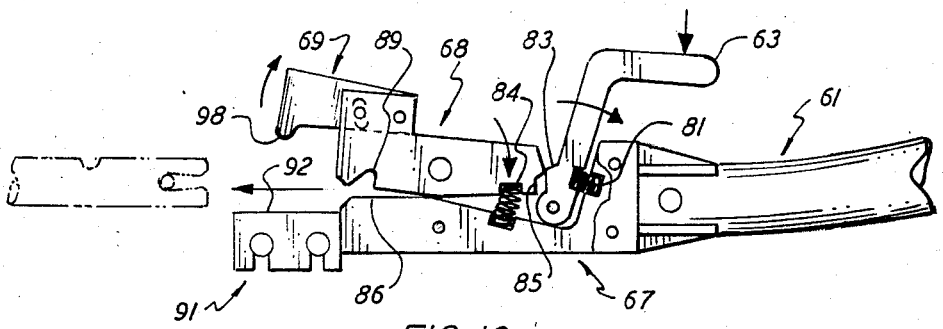
FIG. 12 is a view similar to FIG. 11 showing the jaws in an open position at the time of release.

As best illustrated in FIGS. 11 and 12, with the arrow secured in the release mechanism, the trigger holds the releasable jaws in a locked or closed condition. At this time the nocking spool is captured between the jaws as shown in FIG. 11 and the nock is held against the table by the bar 98. After the bow is drawn fully and the target sighted, the trigger is depressed to unlatch the movable jaw member. Upon release, the compression spring rapidly pulls the movable jaw away from the nocking spool to simultaneously release the bowstring and the nock thereby launching the arrow. As should be now evident, because of the dual-action of the release mechanism, the arrow moves smoothly off the bowstring and it is initially propelled along a line of flight described by the central axis of the arrow. Accordingly, the accuracy of the bow is greatly improved without having to alter or rework any of its parts. This coupled with the rapidly adjustable peep sight aligner provides the archer with an instrument that is believed to be superior to any presently available in the art.

A tongue 100 is contained at the rear of the stationary jaw 67 which is slidably received within a cutout provided in the handle 61. The handle is securely affixed to the tongue by means of a screw 101. The handle is generally arcuate in form to easily fit into the archer's hand. The cylindrical pressure plate 62 is a swivel mounted on the back of the handle by means of a threaded pin 102. The pressure plate contains a V-shaped hole 103 through which the pin passes. The plate is arranged to rest on the pin at the apex of the V and is thus able to adjust or seat against the heel of the hand to prevent the grip from slipping out of the hand as the bow is drawn. Although not shown, the hand engaging surfaces of both the handle and the pressure plate can be covered with a soft, non-slip material to further enhance the archer's grip as well as protecting the hand.

While this invention has been described with reference to the method disclosed herein, it is not confined to the details set forth and this application is intended to cover any modifications or changes as may come within the scope of the following claims.

I claim;

1. Apparatus for drawing, aiming, and firing a bow having limbs and a cable secured thereto that includes a bowstring connected at both ends to the cable, said bowstring further including a spool for being slidably received in a nock mounted on an arrow, a peepsight aligner having a swage secured to one end of the cable and an eyelet secured to one end of the bowstring, a threaded shank for mounting the eyelet in the swage and locking means acting between the shank and the swage for holding the eyelet in an aligned position, a hand-held release mechanism for releasably engaging the nock of the arrow to permit the bow to be drawn, and trigger means operable to disengage the nock and release the arrow.

2. The apparatus of claim 1 wherein said release mechanism further includes a holding means for engaging the bowstring spool whereby the spool is held therein during the drawing and aiming of the bow.

3. The apparatus of claim 1 wherein said release mechanism includes a holding means for engaging the nock of the arrow whereby the nock is held therein during the drawing and aiming of the bow.

4. The apparatus of claim 1 wherein said release mechanism further includes a first holding means for engaging the bowstring spool and a second holding means for engaging the arrow nock whereby both the spool and the nock are held therein during the drawing and the aiming of the bow.

5. The apparatus of claim 4 wherein said trigger means functions to simultaneously release the said first and second holding means at the time the arrow is released.

6. Apparatus for drawing and firing an arrow from a bow so that the flight of the arrow at release is along a path of travel described by the axis of the arrow, comprising a nock secured to the rear of an arrow having two perpendicularly aligned slots passing inwardly through the back face of the nock, so that said slots pass one through the other, said slots including a first deeper release slot and a second, shallower nocking slot, said nock further including a recessed groove formed in the periphery of the nock forward of said release slot, a bowstring attached to the bow having a cylindrical spool secured thereto that is slidably received within the nocking slot, a hand-held release mechanism having a pair of coacting jaw members that are slidably received in said release slot, said jaw members being movable between a first, closed position wherein the spool in the nock is captured between said jaw members and a second, open position wherein the spool is released by said jaw members, a locking bar secured to one of said jaw members for engaging the groove in said nock when the jaw members are closed to center the nock in said mechanism, spring means for urging the jaws into the open position, trigger means for releasably securing the jaw members in the closed position, and means operable therewith for releasing the jaw members whereby the latter are permitted to be opened by said spring means, and a bowcable to which the bowstring is attached and a peep sight aligner having a swage secured to one end of the cable, an eyelet threaded into the swage which is secured to one end of the bowstring, and locking means acting between the eyelet and the swage for holding the eyelet in an aligned position.

7. The apparatus of claim 6 wherein said bowstring is fabricated from an endless length of dacron that is looped back and forth to form a plurality of parallel strands and sleeve means placed over the strands to hold the strands in parallel alignment.

* * * * *